US006636127B2

(12) United States Patent
Van Meter

(10) Patent No.: US 6,636,127 B2
(45) Date of Patent: Oct. 21, 2003

(54) BROADBAND TURNSTILE WAVEGUIDE JUNCTION

(75) Inventor: C. Sterling Van Meter, Saratoga, CA (US)

(73) Assignee: Lockheed Martin Corp., Bethesda, MD (US)

( * ) Notice: Subject to any disclaimer, the term of this patent is extended or adjusted under 35 U.S.C. 154(b) by 24 days.

(21) Appl. No.: 10/082,628

(22) Filed: Feb. 23, 2002

(65) Prior Publication Data

US 2003/0160663 A1 Aug. 28, 2003

(51) Int. Cl.[7] ..... H01P 5/19; H01P 5/12
(52) U.S. Cl. ..... 333/125; 333/137
(58) Field of Search ..... 333/125, 21 R, 333/137

(56) References Cited

U.S. PATENT DOCUMENTS 3,978,434 A * 8/1976 Morz et al. ..... 333/135
4,039,975 A * 8/1977 Debski ..... 333/122
4,460,898 A * 7/1984 Silinsky ..... 343/777
5,003,321 A * 3/1991 Smith et al. ..... 343/781 R
6,313,714 B1 * 11/2001 Junker et al. ..... 333/125

* cited by examiner

*Primary Examiner*—Patricia Nguyen
(74) *Attorney, Agent, or Firm*—Kenneth N. Feat

(57) ABSTRACT

A broadband turnstile waveguide junction has four rectangular side ports that lie in a common plane, symmetrically about and orthogonal to a longitudinal axis of a circular port. The turnstile waveguide junction comprises a circular to quad-ridged waveguide transition disposed between the circular port and the four rectangular side ports. Quad-ridged waveguide ridges are provided that transition to a single ridged waveguide in the four rectangular side ports. A transition is provided from the single ridged waveguide to rectangular waveguide in the side ports. A center matching post, or pedestal, extends from the rear of the junction a predetermined distance toward the circular port. Another embodiment may use a quad-ridged waveguide having a port at the input in lieu of a circular to quad-ridged transition. Another embodiment may use single ridged waveguides at each side port instead of transitioning from single ridged waveguide to rectangular waveguide. Another embodiment may use a double ridged waveguide at each side port.

8 Claims, 1 Drawing Sheet

BROADBAND TURNSTILE WAVEGUIDE JUNCTION

BACKGROUND

The present invention relates generally to waveguide junctions, and more particularly, to a broadband turnstile waveguide junction.

Prior art relating to the present invention may be found in an article entitled "*Application of the Turnstile Junction*", by Maurice A. Meyer and Harold B. Goldberg, IRE Transactions—Microwave Theory & Techniques, December, 1955, pages 40–45. While generally discussing turnstile waveguide junctions, the above article does not disclose or suggest a turnstile waveguide junction that has a circular to quad-ridged waveguide transition, a quad-ridged to single-ridged waveguide transition, a single-ridged to rectangular waveguide transition, or a tapered transitional matching center pin.

It is therefore an objective of the present invention to provide for an improved broadband turnstile waveguide junction.

SUMMARY OF THE INVENTION

To accomplish the above and other objectives, the present invention provides for an improved broadband turnstile waveguide junction. The broadband turnstile waveguide junction comprises a body having four rectangular side ports that lie in a common plane, symmetrically about and orthogonal to the longitudinal axis of a circular port.

The broadband turnstile waveguide junction also comprises a circular to quad-ridged waveguide transition disposed between the circular port and the four rectangular side ports. A quad-ridged to single-ridged waveguide transition is provided to transition to the single ridged waveguide in the four rectangular side ports. Each of the rectangular side ports comprises a single-ridged to rectangular waveguide transition. A tapered transitional matching center pin or pedestal extends from the rear of the junction a predetermined distance toward the circular port.

An alternative embodiment of the broadband turnstile waveguide junction may use a quad-ridged waveguide having a port at the input in lieu of a circular to quad-ridged transition. Another embodiment may use single ridged waveguides at each side port rather than transitioning from single ridged waveguide to rectangular waveguide. Yet another embodiment may use a double ridged waveguide at each side port.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

Figure 1:
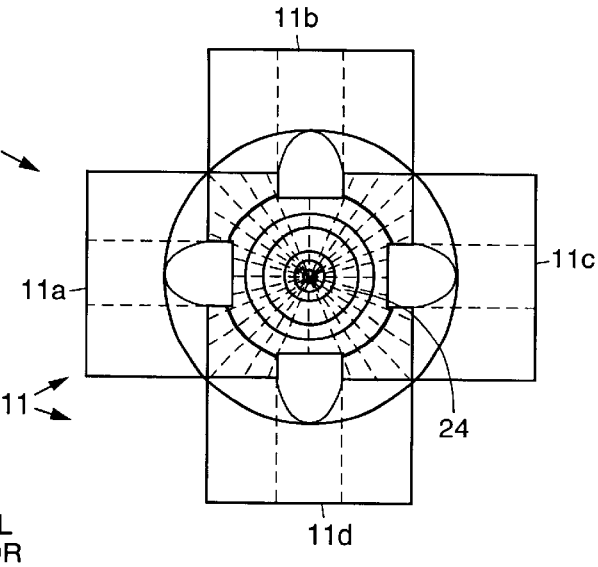
FIG. 1 illustrates a front end view of an exemplary turnstile waveguide junction in accordance with the principles of the present invention.
Figure 2:
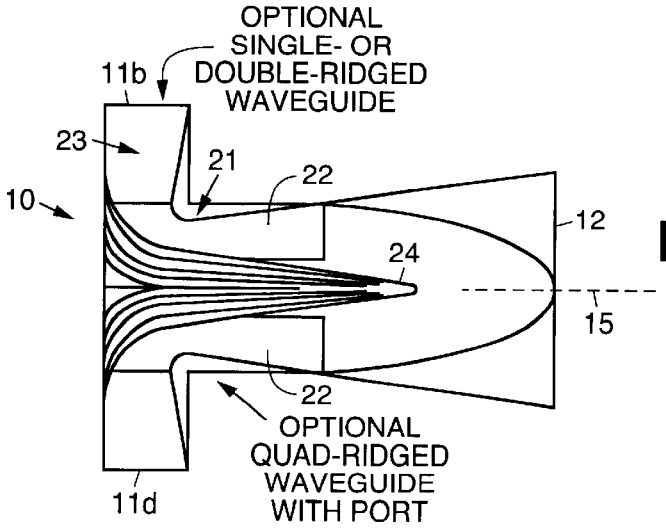
FIG. 2 illustrates a cross sectional view of the exemplary turnstile waveguide junction.
Figure 3:
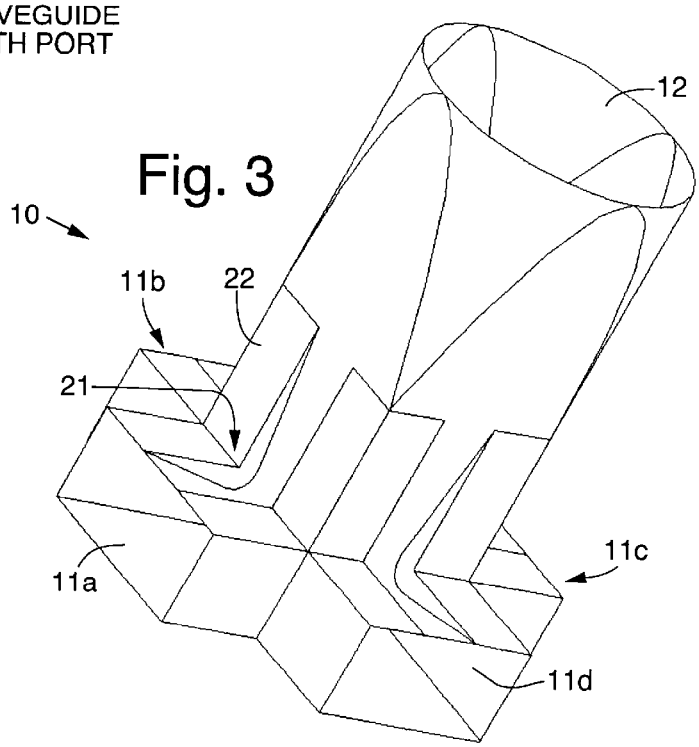
FIG. 3 illustrates a perspective view of the exemplary turnstile waveguide junction.

Referring to the drawing figures, FIG. 1 illustrates a front end view of an exemplary turnstile waveguide junction 10 in accordance with the principles of the present invention. FIG. 2 shows a cross sectional view of the exemplary turnstile waveguide junction 10, while FIG. 3 shows a perspective view of the exemplary turnstile waveguide junction 10.

The present turnstile waveguide junction 10 comprises four rectangular side ports 11 (11*a*, 11*b*, 11*c*, 11*d*) that lie in a common plane, symmetrically about and orthogonal to a longitudinal axis 15 (illustrated by a dashed line) of a circular port 12. The turnstile waveguide junction 10 is unique compared to conventional turnstile waveguide junctions because of the following additional features.

The turnstile waveguide junction 10 comprises a circular to quad-ridged waveguide transition 21 disposed between the circular port 12 and the four rectangular side ports 11. Quad-ridged waveguide ridges 22 are provided that transition to a single ridged waveguide in the four rectangular side ports 11. A transition 23 is provided from the single ridged waveguide to rectangular waveguide in side ports. A center matching post 24 or pedestal 24, which is preferably tapered, extends from the rear of the junction 10 a predetermined distance toward the circular port 12.

The turnstile waveguide junction may be used to provide broadband continuous-wave (CW) duplexing of RF energy. The turnstile waveguide junction may be used to generate elliptical polarization, transmit linear and receiving cross linear polarization, transmit and receive linear polarization, and transmit and receive circular polarization. The turnstile waveguide junction may also be used to provide four way symmetrical power division and measure the degree of ellipticity of circularly polarized waves.

The turnstile waveguide junction may be used in broadband applications. The turnstile waveguide junction is implemented using appropriately sized circular to quad-ridged waveguide transition, quad-ridged section, single-ridged to rectangular waveguide transitions and impedance matching center pin, which provide a more gradual impedance transformation resulting in a broader bandwidth than conventional turnstile waveguide junctions.

Another embodiment of the present invention may use a quad-ridged waveguide having a port at the input in lieu of a circular to quad-ridged transition 21. Yet another embodiment of the present invention may use single ridged waveguides at each side port 11 rather than transitioning from single ridged waveguide to rectangular waveguide.

Yet another embodiment of the present invention may use a double ridged waveguide at each side port 11. This may be accomplished by modifying the aforementioned single ridged to rectangular waveguide transition such that the ridge is retained and by adding a second ridge which emanates from the base of the center post 24 or pedestal 24 and morphs into a lower ridge at each side port 11.

Thus, an improved broadband turnstile waveguide junction has been disclosed. It is to be understood that the above-described embodiment is merely illustrative of some of the many specific embodiments that represent applications of the principles of the present invention. Clearly, numerous other arrangements can be readily devised by those skilled in the art without departing from the scope of the invention.

What is claimed is:

1. A broadband turnstile waveguide junction comprising:

a circular port;

four rectangular side ports that lie in a common plane, symmetrically about and orthogonal to a longitudinal axis of the circular port;

a circular to quad-ridged waveguide transition disposed between the circular port and the rectangular side ports;

quad-ridged waveguide ridges that transition to a single ridged waveguide in the four rectangular side ports;

a transition from the single ridged waveguide to rectangular waveguide in the rectangular side ports; and a center matching post extending from the rear of the junction a predetermined distance toward the circular port.

2. The waveguide junction recited in claim 1 wherein the center matching post is tapered.

3. A broadband turnstile waveguide junction comprising:

a port;

four rectangular side ports that lie in a common plane, symmetrically about and orthogonal to a longitudinal axis of the port;

a quad-ridged waveguide disposed between the port and the rectangular side ports;

quad-ridged waveguide ridges that transition to a single ridged waveguide in the four rectangular side ports;

a transition from the single ridged waveguide to rectangular waveguide in the rectangular side ports; and a center matching post extending from the rear of the junction a predetermined distance toward the port.

4. The waveguide junction recited in claim 3 wherein the center matching post is tapered.

5. A broadband turnstile waveguide junction comprising:

a circular port;

four rectangular side ports that lie in a common plane, symmetrically about and orthogonal to a longitudinal axis of the circular port;

a circular to quad-ridged waveguide transition disposed between the circular port and the rectangular side ports;

a single ridged waveguide at each of the four rectangular side ports;

a transition from the single ridged waveguide to rectangular waveguide in the rectangular side ports; and a center matching post extending from the rear of the junction a predetermined distance toward the circular port.

6. The waveguide junction recited in claim 5 wherein the center matching post is tapered.

7. A broadband turnstile waveguide junction comprising:

a circular port;

four rectangular side ports that lie in a common plane, symmetrically about and orthogonal to a longitudinal axis of the circular port;

a circular to quad-ridged waveguide transition disposed between the circular port and the rectangular side ports;

a double ridged waveguide at each of the four rectangular side ports;

a transition from the double ridged waveguide to rectangular waveguide in the rectangular side ports; and a center matching post extending from the rear of the junction a predetermined distance toward the circular port.

8. The waveguide junction recited in claim 7 wherein the center matching post is tapered.

* * * * *